US005685449A

United States Patent [19]

Oblak

[11] Patent Number: 5,685,449

[45] Date of Patent: Nov. 11, 1997

[54] LUG LID FOR MATERIALS CONTAINER WITH SACRIFICIAL DEPRESSIONS AND ANNULAR EXPANSION BEAD

[75] Inventor: James A. Oblak, Valdosta, Ga.

[73] Assignee: Brockway Standard, Inc., Atlanta, Ga.

[21] Appl. No.: 619,329

[22] Filed: Mar. 21, 1996

Related U.S. Application Data

[63] Continuation-in-part of Ser. No. 377,800, Jan. 24, 1995, abandoned.

[51] Int. Cl.[6] ..... B65D 41/12

[52] U.S. Cl. ..... 220/310.1; 220/609; 220/622; 220/624

[58] Field of Search ..... 220/782, 608, 220/609, 622, 623, 624, 240, 269, 270, 309.1, 309.2, 310.1; 215/260, 261, 270, 271

[56] References Cited

U.S. PATENT DOCUMENTS

| | | | |
|---|---|---|---|
| 700,576 | 5/1902 | Thompson . | |
| 829,477 | 8/1906 | Kruse . | |
| 1,182,466 | 5/1916 | Ferguson . | |
| 1,215,724 | 2/1917 | Shaffer . | |
| 1,744,712 | 1/1930 | Bennett . | |
| 2,148,468 | 2/1939 | Hothersall . | |
| 2,205,685 | 6/1940 | Conner . | |
| 2,335,647 | 11/1943 | Chamberlain . | |
| 3,142,409 | 7/1964 | Ross | 220/624 X |
| 3,525,455 | 8/1970 | Saunders | 220/624 X |
| 3,878,963 | 4/1975 | Knize . | |
| 3,921,848 | 11/1975 | Dolveck . | |
| 3,979,015 | 9/1976 | Arfert . | |
| 4,037,752 | 7/1977 | Dulmaine et al. | 220/609 X |
| 4,113,133 | 9/1978 | Berthet . | |
| 4,175,670 | 11/1979 | Reynolds et al. | 220/609 X |
| 4,431,112 | 2/1984 | Yamaguchi | 220/609 X |
| 4,457,465 | 7/1984 | Shepard et al. . | |
| 4,513,872 | 4/1985 | Bull . | |
| 4,789,076 | 12/1988 | Jewitt et al. . | |
| 4,938,051 | 7/1990 | Duffy et al. . | |
| 5,086,944 | 2/1992 | Duffy et al. . | |
| 5,115,938 | 5/1992 | Thompson . | |

FOREIGN PATENT DOCUMENTS

| | | | |
|---|---|---|---|
| 552834 | 2/1958 | Canada . | |
| 5112357 | 5/1993 | Japan | 220/270 |
| 607109 | 8/1948 | United Kingdom . | |

*Primary Examiner*—Allan N. Shoap
*Assistant Examiner*—Nathan Newhouse
*Attorney, Agent, or Firm*—Thomas, Kayden, Horstemeyer, & Risley

[57] ABSTRACT

A lug lid (10) which closes an open head pail (12) has lugs (31) that overlap the annular rim (19) of the pail and which are crimped thereabout to attach the lid to the pail. An annular expansion bead (38) is formed in the lid to enable the lid to expand to relieve some of the increases in internal pressure which might occur in the container. Sacrificial depressions (46) are formed in the lid (10) adjacent the expansion bead (38) with each sacrificial depression radially aligned with a lid lug (31). The sacrificial depressions selectively weaken the lid to control the formation of wrinkles (47) in the lid in response to increased pressure within the materials container, with such wrinkles being formed in radial alignment with the lugs of the lid, where the connection between the lid (10) and the pail (12) is strongest.

20 Claims, 3 Drawing Sheets

LUG LID FOR MATERIALS CONTAINER WITH SACRIFICIAL DEPRESSIONS AND ANNULAR EXPANSION BEAD

CROSS REFERENCE

This is a continuation-in-part of patent application Ser. No. 08/377,800 filed Jan. 24, 1995, now abandoned, and priority is claimed with respect to provisional application Ser. No. 60,004,301, filed Sep. 26, 1995.

FIELD OF THE INVENTION

The present invention relates to a cylindrical, upright materials container having an open upper end and a lug lid adapted to fit over and seal against the circular rim of the upper end of the container. The lid includes a series of lugs about its periphery which are crimped about the rim of the container at its upper end to secure the lid to the container.

BACKGROUND OF THE INVENTION

It is common in the storage and transport of volatile, toxic and hazardous materials such as paint, acid, oil, etc. to use an open head sheet metal container which is securely closed by a lug lid. A commonly used type of materials container is a five gallon open-ended pail or bucket which has a curled annular rim formed about an open upper end. A lid is received over and attached to the annular rim of the pail to enclose the materials therewithin. The lid for such materials container generally is substantially disk-shaped, including a flat base plate with a raised downwardly facing annular connecting channel circumscribed thereabout. The connecting channel of the lid is adapted to fit over and rest upon the annular rim of the pail. A soft sealing material is positioned in the annular connecting channel to form an air tight seal between the rim of the pail and the connecting channel of the lid. A series of lid lugs project downwardly from the annular channel of the lid for attaching the lid to the container rim.

Typically, the lug lid of a five gallon pail will have between 16 to 20 lugs formed in spaced series about the circumference of the lid with spaces formed between the lugs. The pail is filled with the material to be contained therein, such as paint, putty, acid, fuel, etc., and the lid is applied to the open upper end of the pail, with the annular connecting channel and soft sealing material in the channel of the lid seated on the annular rim of the pail. The lid is sealed to the container by engagement of crimping elements of a crimping tool with the lugs of the lid. The crimping tool urges the lugs inwardly and upwardly against the annular rim of the pail so that the lugs are crimped and wrapped about the annular rim of the pail to compress the annular connecting channel and its sealing material against the pail rim and to secure the lid to the annular rim of the pail in a sealed arrangement.

A problem that arises with the storage and transport of volatile materials in conventional lug lid containers is that when these materials are heated or shaken, the pressure in the containers tend to increase. Such increased pressure is exerted in all directions, including upwardly against the lid. As a result of the increased pressure, buckles or wrinkles are formed in the lid and if a wrinkle of the lid intersects the annular connecting channel of the lid, an opening is likely to be formed between the lid and the rim of the pail, allowing the contents of the container to escape.

FIGS. 1 and 2 illustrate a prior art lug lid 1 of the type applied to a conventional five gallon pail, illustrating the lugs extending radially (FIG. 1) so that their positions can be seen and illustrating the formation of typical wrinkles or buckles 2 in the lid formed in response to an excess of pressure being formed within the container after the container was closed and sealed by the lid. As shown in FIGS. 1 and 2, such wrinkles 2 tend to format varying points about the lid, extending radially outwardly from the center of the lid toward gaps or spaces 3 between the lugs 4 of the lid. The wrinkles generally tend to form at the gaps 7 between the lid lugs because these are the points of least contact between the lid 1 and the rim 6 (FIG. 2) of the pail and thus are the points where the seal between the lid and container rim are the weakest. The formation of wrinkles or buckles in the lid as illustrated in FIGS. 1 and 2 tend to cause the portion of the lid at the wrinkle to be urged upwardly and pushed away from the container rim 6 (FIG. 2), leaving an opening 7 between the lid and the rim. As a result, the seal between the lid and the container is broken, enabling the contents of the container to be expelled from and to leak out of the container and to be exposed to the surrounding environment.

Generally, to reduce the likelihood of wrinkles being formed in a lid, the trend in the art has been to use heavier gauge metals to form the containers and their mating lids. The use of such heavier gauge metals is designed to make the rims of the containers and the lids stronger and more resistant to increases in pressure within the containers to avoid rupture and failure of the seal between the lids and the upper rims of the containers. A problem with using such heavier gauge metals is that such metals are more expensive and increase the weight of the containers. This leads to increases in the costs of manufacturing the containers and to an increase in the costs of transporting and storing hazardous materials. Additionally, such heavier gauge metals are more difficult to shape and form so that it is more difficult and costly to form the rims of the containers and to crimp the lugs of the lids about the rims of the containers. The stronger metals further make it more difficult to open the containers once sealed.

Accordingly, it can be seen that a need exists for improved lug lid design for a materials container that resists the rupture and/or breaking of the seal between the lid and the rim of the container as pressures increase within the container, and which can be formed from lighter gauge metals so as to be easier and cheaper to manufacture.

SUMMARY OF THE INVENTION

Briefly described, the present invention comprises an upright cylindrical container with a lug lid for storing and shipping flowable materials such as paint, putty, liquid wastes and other materials which may be volatile or hazardous materials. The lug lid is constructed to attach to the upper open end of an open-head upright cylindrical sheet metal pail of the type formed from rolled steel or a similar suitable material. The pail generally includes a substantially cylindrically shaped pail body having an annular upper rim forming an open upper end of the pail. The annular rim of the pail typically is formed as a curl at the upper open end of the pail body, spiraling over and outwardly from the pail body.

The lug lid generally is a substantially circularly shaped plate or disk usually formed from the same type of material as the container. The lid includes a flat, circular central body portion, and a raised annular connecting channel formed about the circumference of the lid, forming an outer rim thereof. A sealing material is applied within the underside of the annular channel for aiding in forming a substantially airtight seal between the lid and the pail rim. A series of lugs are formed about the circumference of the lid, projecting downwardly from the annular connecting channel. The lid lugs generally are substantially rectangularly or oval shaped flanges arranged at spaced intervals about the circumference of the lid. Typically, sixteen to twenty lugs will be formed about the circumference of the lid of a five-gallon container with spaces or gaps separating adjacent lugs. The lugs are adapted to be engaged by a conventional crimping element of a crimping tool during a crimping operation. The lugs are wrapped or compressed about the rim of the container as force is applied to the lugs by the crimping tool to pull the lid against the upper rim of the container in a tight sealed engagement therewith.

An annular expansion bead is formed in the body portion of the lid between the connecting channel at the edge of the lid and the central body portion of the lid, spaced concentrically inwardly from the annular connecting channel of the lid. When viewed in cross section, the annular expansion bead has a generally inverted V shape, having an inner sloped wall facing the center of the lid and a sloped outer wall facing the connecting channel of the lid, with the bead walls intersecting each other at a ridge that projects upwardly from the lid. When the lid is lifted by internal pressure of the container, the inner sloped wall is tilted further toward a horizontal attitude, thereby urging the outer sloped wall and the portion of the lid between the expansion bead and the connecting channel outwardly, tending to tighten the seal between the lid and the pail.

Additionally, a series of sacrificial depressions or dimples are formed in the lid at the intersection of the inner wall of the expansion bead with the flat body portion of the lid. The sacrificial depressions are small, substantially circularly shaped areas of reduced thickness in the metal of the lid. The sacrificial depressions each are radially aligned with a lid lug. Typically there will be half as many sacrificial depressions as there are lugs and each depression will be placed in radial alignment with every other lug. For example, eight sacrificial depressions are formed in a lid having sixteen lugs, with each depression radially aligned with every other lug.

The sacrificial depressions weaken the body portion of the lid at the intersection of the flat body portion with the inner bead wall of the annular expansion bead. As a result, as the pressure increases within the materials container causing wrinkles to be formed in the lid, the lid will form wrinkles which tend to intersect the weaker sacrificial depressions of the lid and therefore each wrinkle formed in the lid becomes aligned with a lid lug. The sacrificial depressions thus ensure that the wrinkles formed in the lid will be aligned with the lugs of the lid where the seal between the lid and the pail rim is strongest instead of becoming aligned with spaces between the lugs where the seal between the lid and the pail rim is the weakest. The buckling and wrinkling of the lid forms more interior space inside the container and therefore tends to relieve pressure within the container. Accordingly, increases in pressure within the container are compensated for and are partially relieved by the wrinkles with the danger of failure of the seal between the lid and container rim being minimized.

It therefore is an object of the present invention to provide an improved lug lid materials container such as a five gallon cylindrical sheet metal pail which includes a lid that resists breaching of the seal between the lid and the rim of the pail due to increased pressure within the materials container.

Another object of the present invention is to provide an improved lug lid for a materials container having a series of sacrificial depressions formed therein which ensure that any buckling or wrinkles formed in the lid will be aligned with a lug of the lid to minimize the potential for the breaching of the seal between the lid and the rim of the materials container.

Another object of the present invention is to provide a lug lid for a materials container such as a five gallon cylindrical sheet metal container that enables a high strength, air-tight seal to be formed between the lid and the rim of the pail and which can be formed from lighter gauge metals so as to be easier and cheaper to manufacture and use.

Another object of the invention is to provide an upright cylindrical materials container which includes a pail that is closed with a lug lid, with the lug lid having weakened areas radially aligned with the lugs which induce any wrinkles which may result from an increase in pressure within the container to become radially aligned with the lugs of the lid instead of the spaces between the lugs.

Another object of this invention is to provide a materials container which as a lug lid having an annular expansion bead and a series of sacrificial depressions adjacent the annular expansion bead and each depression being radially aligned with the lug of the lid, wherein wrinkles can form in the lid due to increased pressure within the container, with the wrinkles becoming aligned with the lugs of the lid instead of becoming aligned with the spaces between the lugs and with the expansion of the lid tending to cause a portion of the lid to be urged into tighter sealing contact with the sidewall of the container to enhance the seal between the lid and the container.

Other objects, features, and advantages of the present invention will become apparent to those skilled in the art upon review of the following detailed description when taken in conjunction with the accompanying drawings.

DETAILED DESCRIPTION

Figure 1:
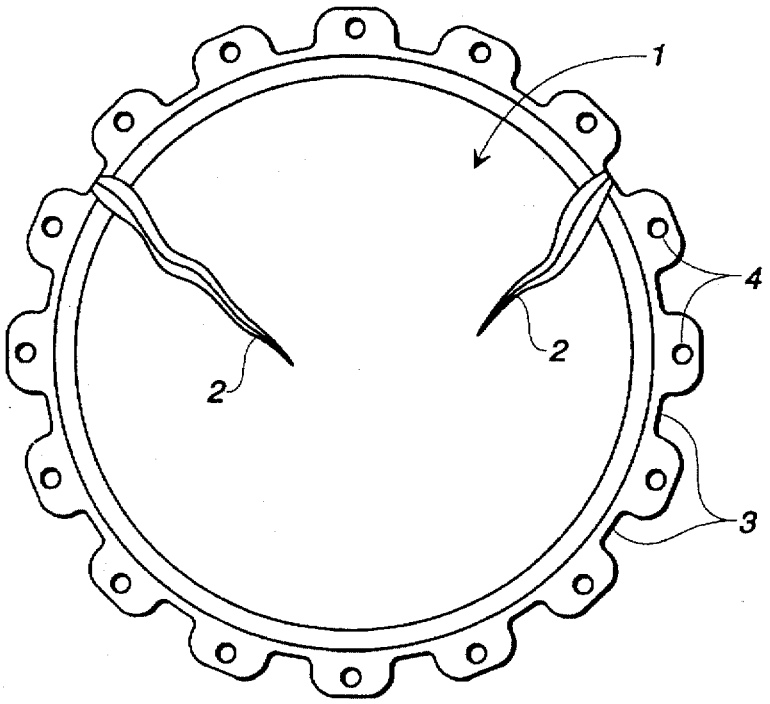
FIG. 1 PRIOR ART
FIG. 1 is a top plan view of a prior art lug lid, showing the lugs extending radially for the purpose of clearly showing their positions about the lid and illustrating wrinkles formed in the lid due to an increase of internal pressure within the container to which the lid was attached.
Figure 2:
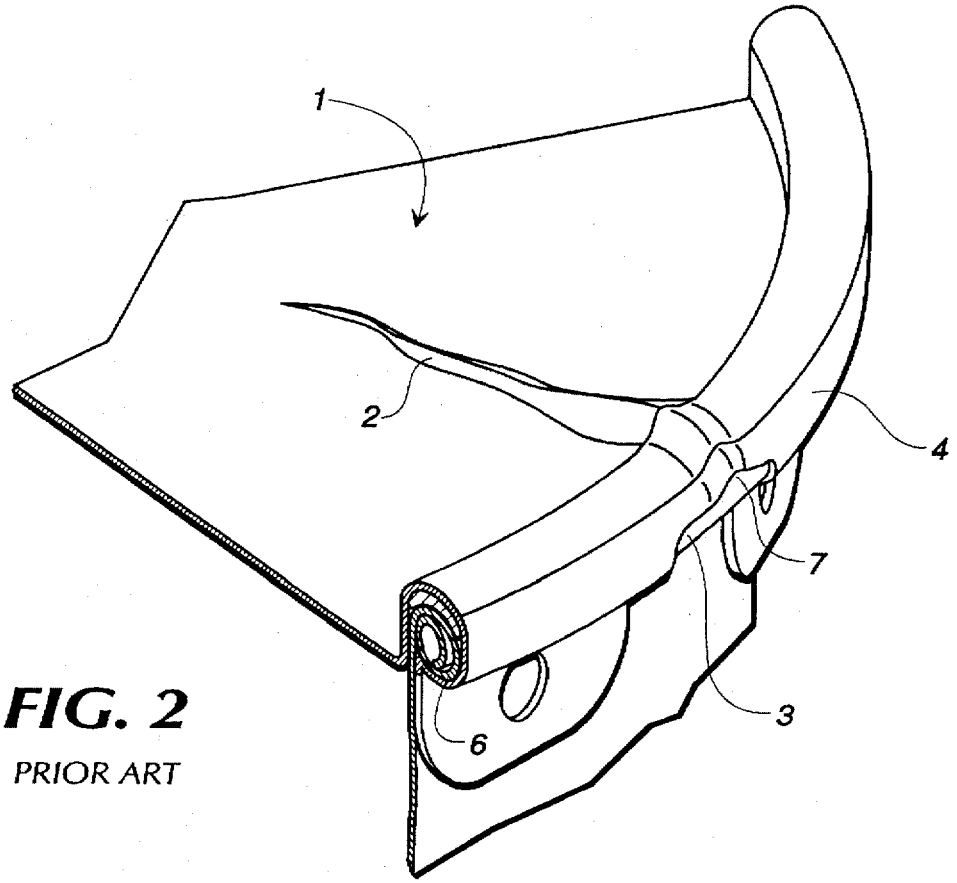
FIG. 2 PRIOR ART
FIG. 2 is a perspective view with parts cut away, of a materials container with a prior art lug lid applied thereto, showing a wrinkle formed in the lid and breaching the seal between the annular rim and the lid.
Figure 3:
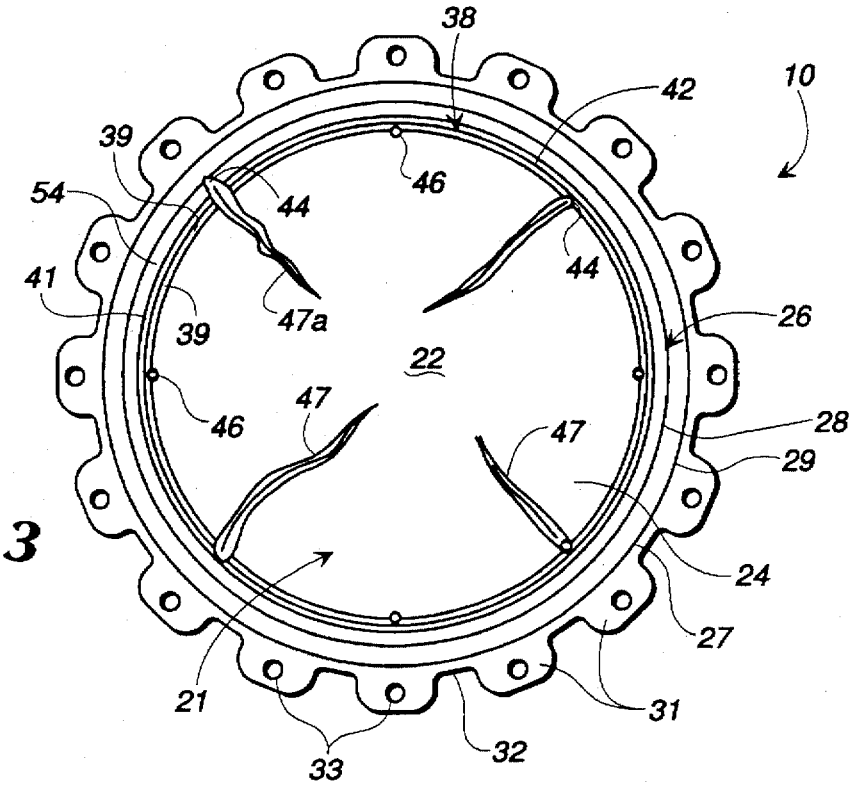
FIG. 3 is a top plan view of the lug lid of the present invention, showing the lugs extending radially for the purpose of clearly showing their positions about the lid and illustrating the formation of wrinkles in the lid due to an increase of internal pressure within the container to which the lid was attached.
Figure 4:
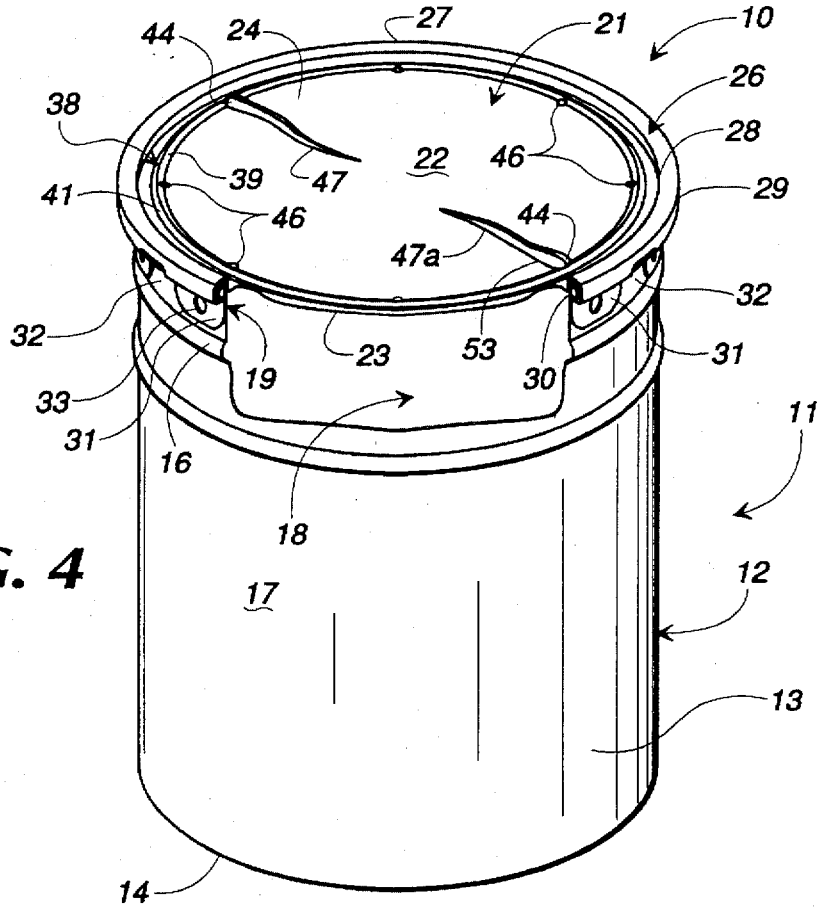
FIG. 4 is a perspective view, with parts cut away, of a pail with the lug lid of the present invention applied to it, illustrating the formation of wrinkles in the lid in response to increased pressure formed in the container.

Referring now in greater detail to the drawings in which like numerals indicate like parts throughout the several views, FIGS. 3 and 4 illustrate the lug lid 10 of the present invention, for use in forming the materials container 11 that is suitable for the storage and transport of materials such as paint, liquid waste, putty, acid and other flowable volatile, toxic and/or hazardous materials in a sealed, airtight condition. The materials container 11 generally comprises an open-head pail or bucket 12 (FIG. 4) formed from a sheet metal such as steel or similar high-strength, resilient material. The pail 12 typically is a one to five gallon capacity pail or bucket that includes a cylindrical container body 13 having a conventional closed lower end and an open upper end 16, and a cylindrical sidewall 17. The side wall and lower end of the container body define an open-ended storage chamber 18 within which the materials to be stored and/or transported are received.

Figure 6:
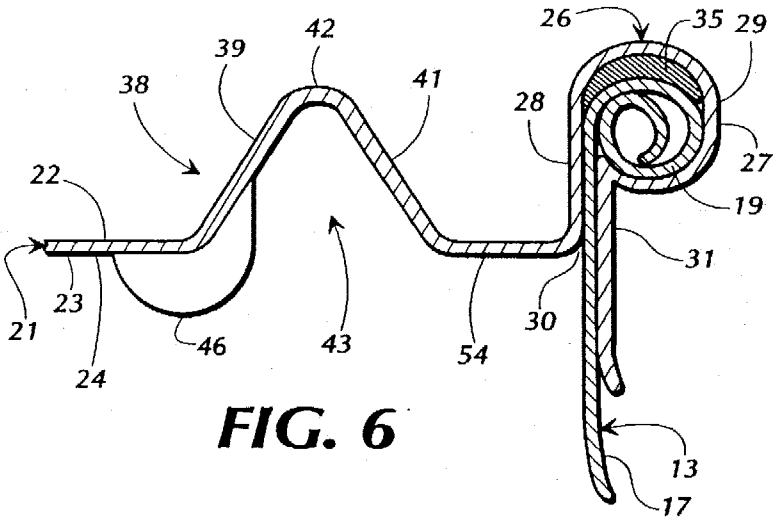
FIG. 6 is a cross sectional view of portions of the lid and the pail after the lid has been crimped to the pail, showing the annular expansion bead in its normal, non-expanded shape.
Figure 7:
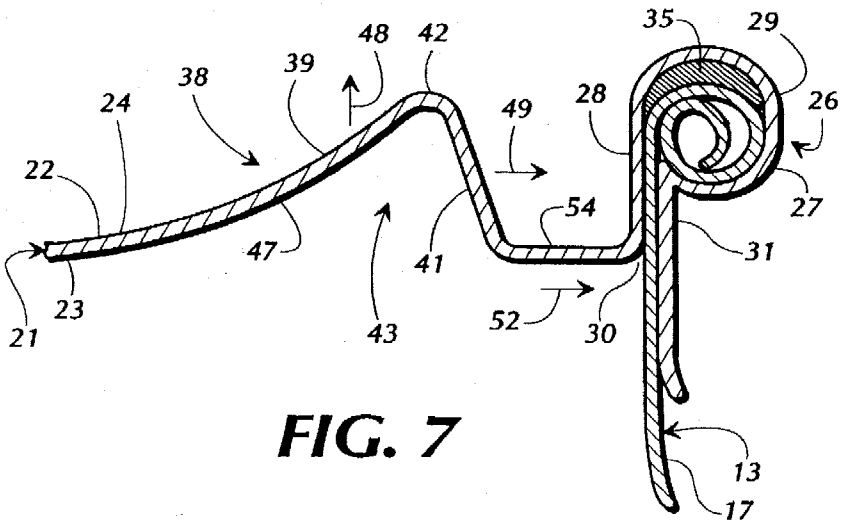
FIG. 7 is a cross sectional view, similar to FIG. 6, but showing the shape and movements of the lid when a wrinkle is formed in the lid in response to increased internal pressure in the container.
Figure 5:
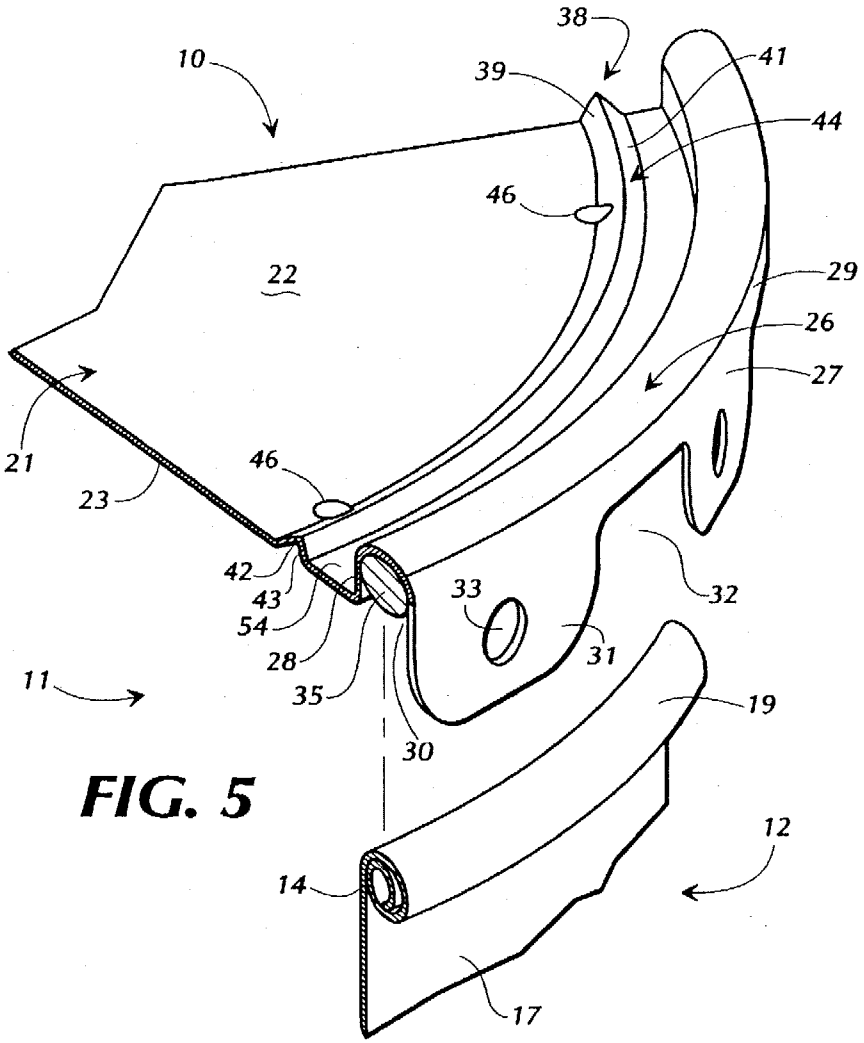
FIG. 5 is an expanded perspective view of a portion of the lug lid and a pail of the present invention, illustrating the annular expansion bead and sacrificial depressions formed in the lid before the lid is applied to the pail.

A curled annular rim 19 is formed about the upper end of the pail 12 from the material of the pail body. As shown in FIGS. 5–7, the annular rim 19 of the pail typically is formed in cross section as a spiral or compound curl of rolled metal, and extends about the circumference of the open upper end of the pail. The lug lid 10 is received and seated upon the annular rim for attachment of the lug lid to the pail.

As illustrated in FIGS. 3 and 5, the lug lid 10 generally comprises a substantially circularly shaped disk or base plate 21 having an upper surface 22 and a lower surface 23 that faces the open ended chamber of the pail. The lug lid typically is formed from the same material from which the container body of the materials container is formed. The lug lid includes a central body portion 24 and an annular connecting channel 26 formed about its circumference. The central body portion 24 generally is substantially flat while the annular connecting channel 26 has a raised, inverted U-shaped cross-section, forming an outer rim or edge 27 circumscribed about the lug lid. The connecting channel 26 includes an upwardly extending inner wall 28 and a downwardly extending outer wall 29 which defines an annular recess 30 (FIG. 5), within the lower surface of the lug lid and extending about the circumference thereof. The annular connecting channel 26 is adapted to fit over and telescopically seat upon the annular rim 19 (FIGS. 4, 6 and 7) of the container body 12 with the annular rim 19 received within the annular recess 30 of the lid, for the attachment of the lug lid to the materials container.

A series of lid lugs 31 (FIG. 3) are formed about the periphery of the lug lid, projecting downwardly from the outer wall 29 of the annular connecting channel 26 of the lug lid on the opposite side of the channel from the central body portion 24 of the lid. The lugs overlap the rim 19 (FIG. 4) of the pail and are generally substantially rectangularly shaped flanges or strips of metal projecting from the annular connecting channel of the lid. Typically, sixteen lugs 24 will be formed about the lid of a five gallon container, with the lugs arranged in spaced series about the circumference of the lid with gaps or spaces 32 formed between adjacent lugs. It will, however, be understood that fewer or more lugs, i.e., twelve to twenty lugs, can be formed on the lid as desired. Usually, each of the lugs includes a tool opening 33 formed adjacent its lower end which allows a tool, such as a screw driver, to be placed in the tool opening for bending the lugs away from the pail, to open the container.

A gasket or sealing compound 35 (FIGS. 5 and 7) is applied within the recess 30 of the annular connecting channel 26 of the lid on the underside of the lid. The gasket typically is a compressible foamed material such as foam rubber or a similar elastic material. The gasket generally is applied as a paste and allowed to cure to form a compressive bead within the recess 30. The gasket is adapted to be compressed against the annular rim of the materials container as the lid is crimped thereto. This ensures that a substantially airtight seal will be formed between the lid and the annular rim of the materials container.

As FIGS. 3, 4 and 5 illustrate, an annular expansion bead 38 is formed between the central body portion 24 and the annular channel 26 of the lid, concentric with the channel 26. Viewed in cross-section, the annular expansion bead 38 (FIG. 5) has an inverted, substantially V-shaped configuration, with a sloped inner wall 39 that faces and slopes upwardly from the flat central body portion 24 of the lid 10 and a sloped outer wall 41 facing and sloping downwardly toward the front wall 28 of the annular connecting channel of the lid. The inner and outer bead walls 39 and 41 intersect to form a ridge 42 that projects upwardly from the central body portion of the lid. The expansion bead enables the lid to deform and form break points 44 that intersect the ridge, to substantially equalize and relieve pressure that has built up within the materials container, as illustrated by arrow 48 in FIG. 7, with the seal between the lid and the pail rim maintained to prevent leaks, etc. as internal pressure increases.

Sacrificial depressions or dimples 46 (FIGS. 3 and 5) are formed within a portion of the central body portion 24 of the lid 10 at the intersection of the central body portion 24 and the inner wall 39 of the annular expansion bead 28. Typically, a sacrificial depression 46 will be formed in radial alignment with every other lug 31 of the lid. For example, for a lid having sixteen lugs, eight sacrificial depressions are formed in the lid, with each depression positioned in radial alignment with every other lug of the lid, as illustrated in FIG. 3.

The sacrificial depressions 46 generally are substantially circularly shaped indentions or areas of reduced thickness in the metal of the lid, although the depressions also can be formed in other shapes, such as oval, square or diamond, as desired. The sacrificial depressions weaken the central body portion 24 of the lid 10 in the vicinity of each depression. As a result, when the lid is subjected to increases in internal pressure within the materials container, illustrated by arrows 48 in FIG. 6, wrinkles 47 (FIGS. 3 and 4) are formed in the central body portion of the lid. The wrinkles tend to intersect the sacrificial depressions 46 which are weaker and thus more susceptible to deformation. As a result, and because the sacrificial depressions are aligned with a lug 31, the wrinkles tend to be formed in alignment with the lugs of the lid where the connection between the lid and pail rim is strongest. Thus, as illustrated in FIGS. 3 and 4, the sacrificial depressions function as a means for aligning the wrinkles which tend to form in the lid in response to increased pressure occurring in the container with the lugs of the lid instead of with the spaces between the lugs. The formation of the wrinkles 47 usually is controlled by the lid structure to form in the central portion of the lid first at approximately 180° apart from one another and thereafter tend to form at approximately 90° intervals about the lid.

In use of the materials container 11 (FIG. 4), the inner chamber 18 is filled with a flowable material such as paint, fuel, putty, fertilizer, or other material which may be volatile, hazardous or toxic. After the inner chamber has been filled with the material to be stored, the lug lid 10 is applied over the open upper end 16 of the pail 12. The lug lid is applied to the pail with the annular connecting channel 26 of the lid 10 being telescopically seated over the annular rim 19 about the open upper end of the pail. The annular rim is received within the inverted U-shaped recess 30 defined by the inner and outer walls 28 and 29 of the connecting channel 26, with the gasket material 35 engaging the top of the annular rim and the inner and outer side walls 28 and 29 of the channel extending downwardly adjacent the sides of the rim.

Once the lid has been positioned over the open upper end of the paid, seated on the annular rim thereof, a crimp tool (not shown) is applied to the lid with the hooked crimping elements (not shown) of the crimp tool engaging the lugs 31 of the lid 10. The crimping elements of the crimp tool are pivoted inwardly and slightly upwardly, toward the sidewall 17 of the pail body 13. The weight and movement of the crimp tool urges the lid into tight sealing contact with the annular rim of the pail, compressing the gasket 35 therebetween. The crimp tool likewise causes the lugs of the lid to be urged inwardly and to curl about the annular rim as the annular rim further is curled as well, causing the lid lugs to be wrapped tightly and curled into engaging contact about the rim. As a result, an airtight crimped seal is formed between the lug lid 10 and the pail 12 to form the materials container with the hazardous materials contained therein in a substantially airtight, leakproof arrangement.

During the transport and storage of the sealed materials container, it is possible that the materials container could be subjected to extreme temperatures, changes in atmosphere pressure and/or could be dropped or dented during handling. As a result, the pressure within the inner chamber of the materials container is likely to increase. Such increases-in pressure can lead to ruptures or damage to the seal between the lug lid and the pail of prior art containers, enabling the materials contained within the containers to leak therefrom. The lug lid of the present invention, however, is adapted to specifically deform in a controlled manner as a result of the formation of the annular expansion bead and the sacrificial depressions within the lid. The sacrificial depressions form weak spots in the lid which tend to deform first in response to increases in pressure within the materials container. The sacrificial depressions enable wrinkles to be formed within the lid to accommodate and substantially relieve increased pressure within the materials container, and since the sacrificial depressions are formed in alignment with the lugs 31 of the lid, the wrinkles likewise tend to form in alignment with the lugs of the lid.

The sacrificial depressions 46 thus function as a means for controlling the deformation of the lid, for causing the wrinkles 47 to be formed in a controlled arrangement, in alignment with the strongest points of connection between the lid and the annular rim of the pail, which is where the lugs 31 connect the lid to the pail, instead of forming in alignment with the gaps 32 (FIG. 4) between the lugs 31 which are the weakest points of connection between the lid and the pail. Therefore, should a wrinkle traverse the annular expansion bead and extend to the edge of the lid as shown by wrinkle 47*a* of FIG. 3, the wrinkle will tend to intersect a lug of the lid, not the weaker area of the space between the lugs. The sacrificial depressions thus function as a means for directing and controlling the formation of the wrinkles in and/or the expansion of the lid to accommodate increases in pressure within the pail and reduce the potential for failure of the seal between the lid and the annular rim of the pail.

When a wrinkle 47 is formed radially in the central body portion 24 of the lid and intersects the annular expansion bead, the annular expansion bead tends to retard and usually block the further radial formation of the wrinkle. This avoids having the wrinkle intersect the perimeter of the lid where the connection and seal of the lid is formed with the rim of the pail. Thus, the annular expansion bead functions as a means for retarding a radially extending wrinkle being formed in the central body portion of the lid from intersecting the connecting channel about the perimeter of the lid.

Additionally, when a wrinkle intersects and attempts to cross over the expansion bead 38, a break point 44 (FIGS. 3, 4 and 7) tends to form in the annular bead. The break point in the annular expansion bead 38 usually lifts the sloped inner wall 39 from its normal position as shown in FIG. 6 to its breached position 39a as shown in FIG. 7 and as illustrated by arrow 48 in FIG. 7. This tends to cause an outwardly directed force to be applied to the opposed sloped outer wall 41 of the expansion bead, urging the outer wall 41 toward the pail rim 19 as indicated by arrow 52, and applies an outwardly directed radial force to the annular span 54 of the lid between the expansion bead 38 and the connecting channel 26 of the lid. This results in the inner wall portion 28 of the connecting channel 26 to be urged against the rim 19 of the pail, thereby enhancing the connection between the pail and the lid and further resisting rupture and failure of the seal between the lid and container body.

By controlling the formation of wrinkles within the central portion of the lid and aligning the wrinkles with the lugs of the lid, and/or by using the wrinkles to urge the inner wall 28 of the connecting channel 26 against the rim of the pail, the present invention provides a stronger, more secure seal between the lid and the materials container to which it is attached. Additionally, the present invention enables the use in the fabrication of the container of lighter gauge steel or other metals that are cheaper and easier to form so as to reduce the cost of manufacture of the materials containers and thus make their use for transportation and storage of materials much more cost effective.

It will be understood by those skilled in the art that while the present invention has been disclosed with reference to a preferred embodiment thereof, numerous additions, deletions and modifications can be made thereto without departing from the spirit and scope of the invention as set forth in the following claims.

I claim:

1. A lid for a materials container of the type having a pail body with an annular rim formed about its upper end, said lid comprising:

a central body portion;

an annular connecting channel circumscribed about said central body potion and adapted to engage and seat upon the annular rim of the pail body;

an annular bead formed in said central body portion concentric with said connecting channel;

lid lugs formed in a spaced series about the lid, projecting downwardly from said connecting channel for attaching the lid to the annular rim of the pail body; and sacrificial depressions formed in said central body potion at said annular bead and radially aligned with said lugs, said depressions weakening said lid at positions along said central body portion in radial alignment with said lugs to control the formation of wrinkles resulting from increases in pressure within the materials container.

2. The lid of claim 1 and wherein said annular bead comprises a raised, inverted, substantially V-shaped channel formed about said central body portion.

3. The lid of claim 1 and wherein said lid lugs comprise substantially rectangularly shaped flanges adapted to engage and wrap about the annular rim of the pail body to mount the lid to the pail body.

4. The lid of claim 1 and further comprising a sealant material applied to the lid within said annular connecting channel and adapted to compress against the annular rim of the pail as the lid is applied thereto for creating a seal between the lid and pail body.

5. The lid of claim 1 and wherein said sacrificial depressions intersect said annular bead.

6. In a materials container of the type having a pail body with an annular rim formed about an open end thereof suitable for receiving and containing flowable materials, the improvement therein comprising:

a lid adapted to fit over and seat upon the annular rim of the pail body and having a central body portion and an outer edge with lid lugs formed at spaced intervals about said outer edge for engaging the annular rim of the pail body in crimping engagement to mount said lid against the pail body;

an annular expansion bead formed within said lid internally of said lid lugs and adapted to enable said lid to deform and expand in response to increases in pressure within the materials container; and a series of sacrificial dimples formed in said lid at said annular expansion bead, each of said dimples being radially aligned with a lid lug, said dimples weakening the lid at positions along said annular expansion bead which are radially aligned with said lugs to control the formation of wrinkles within said lid so that such wrinkles are formed in alignment with said lid lugs.

7. The materials container of claim 6 and wherein said lid further includes an annular connecting channel circumscribed about said central body portion and adapted to receive the annular rim of the pail body thereunder.

8. The materials container of claim 6 and wherein said sacrificial dimples are positioned in radial alignment with alternate ones of the lugs of the lid.

9. The materials container of claim 6 and the lid of claim 1 and further comprising a sealant material applied to the lid within said annular connecting channel and adapted to compress against the annular rim of the pail as said lid is applied thereto for creating a seal between said lid and the pail body.

10. The materials container of claim 6 and wherein said sacrificial dimples comprise indentions formed in said lid, said dimples intersecting a portion of said annular expansion bead for weakening said lid in radial alignment with said lid lugs to control the formation of wrinkles in radial alignment with said lid lugs.

11. A materials container for the storage and transport of flowable material comprising:

a pail body having a side wall and an annular rim forming an open end of said pail body;

a circular lid adapted to engage and seat upon said annular rim of said pail body to close said open end of said pail body, said lid having at its edge portion a series of lugs circumferentially formed in spaced series about said lid for securing said lid in sealing engagement to said annular rim of said pail body;

an annular expansion bead formed in said lid radially inwardly of said lugs and concentric with respect to said lid lugs to enable said lid to deform and expand the space in said materials container as pressure of the materials within said materials container increases to substantially relieve such pressure without disturbing the sealing engagement between said lid and said pail body; and means for controlling the deformation of said lid in response to increases in pressure within said materials container to form wrinkles in said lid that become radially aligned with the lugs of the lid.

12. The materials container of claim 11 and wherein said means for controlling the deformation of said lid in response to increase in pressure within said materials container comprises a series of sacrificial depressions formed in said lid in radial alignment with said lid lugs.

13. The materials container of claim 12 and wherein said sacrificial depressions comprise indentions formed in said lid, said indentations intersecting a portion of said annular expansion bead for weakening said lid in radial alignment with said lid lugs to control the formation of wrinkles in alignment with said lid lugs.

14. The materials container of claim 11 and wherein said means for controlling the deformation of said lid include sacrificial depressions which are positioned in radial alignment with fewer than all of the lugs of the lid.

15. The materials container of claim 11 and wherein said lid further includes a central body portion and an annular connecting channel circumscribed about said central body portion and adapted to receive the annular rim of the pail body.

16. A container for storing an shipping of flowable materials comprising:

a pail including a bottom wall and a substantially cylindrical sidewall, an annular rim forming an open end of said pail at its end opposite said bottom wall;

a lid for mounting to said rim and sealing said pail, said lid comprising:

a central body portion and a perimeter portion;

said perimeter portion including an annular connecting channel for surrounding said central body portion and sized and shaped for mounting on said rim;

a series of lugs extending about said perimeter portion for clinching about said annular rim of said pail for holding said lid in closed relationship with respect to said rim of said pail; an annular expansion bead formed in said lid concentrically inwardly of said annular connecting channel; and means for controlling the formation of wrinkles in the lid in response to an increase in pressure within said container so that the wrinkles extend generally radially from said central body portion toward said lugs of the perimeter portion.

17. The container of claim 16 and wherein said means for controlling the formation of wrinkles in the lid comprises dimples in said lid each radially aligned with a lug of the lid.

18. The container of claim 16 and further including means for retarding the formation of wrinkles in the lid intersecting the perimeter of the lid.

19. The container of claim 16 and further including said means for controlling the formation of wrinkles in said lid being positioned adjacent said annular expansion bead.

20. The container of claim 19 and wherein said means for controlling the formation of wrinkles intersect said annular expansion bead.

* * * * *